US005361857A

United States Patent [19]

Horvei

[11] Patent Number: 5,361,857

[45] Date of Patent: Nov. 8, 1994

[54] PRESSURE CONVERTER

[75] Inventor: Knut V. Horvei, Sandnes, Norway

[73] Assignee: Den Norske Stats Oljeselskap a.s., Stavanger, Norway

[21] Appl. No.: 50,445

[22] PCT Filed: Nov. 4, 1991

[86] PCT No.: PCT/NO91/00134

§ 371 Date: Sep. 7, 1993

§ 102(e) Date: Sep. 7, 1993

[87] PCT Pub. No.: WO92/08871

PCT Pub. Date: May 29, 1992

[30] Foreign Application Priority Data

Nov. 19, 1990 [NO] Norway ..... 904989
Nov. 19, 1990 [NO] Norway ..... 904990

[51] Int. Cl.[5] ..... E21B 4/02

[52] U.S. Cl. ..... 175/93; 175/107; 175/324

[58] Field of Search ..... 175/24, 25, 73, 93, 175/105-107, 324

[56] References Cited

U.S. PATENT DOCUMENTS

| | | | |
|---|---|---|---|
| 1,698,343 | 1/1929 | Mortimer et al. . | |
| 3,112,800 | 12/1963 | Bobo | 175/67 |
| 3,893,525 | 7/1975 | Dower et al. | 175/24 |
| 3,897,836 | 8/1975 | Hall et al. | 175/93 |
| 3,927,723 | 12/1975 | Hall et al. | 175/422 |
| 4,047,581 | 9/1977 | Erickson | 175/95 |
| 4,187,918 | 2/1980 | Clark | 175/107 |
| 4,200,158 | 4/1980 | Perkins | 175/297 |
| 4,253,530 | 3/1981 | Sharki et al. | 175/25 |
| 5,246,080 | 9/1993 | Horvei et al. | 175/93 |

FOREIGN PATENT DOCUMENTS

| | | |
|---|---|---|
| 0335543 | 10/1989 | European Pat. Off. . |
| WO83/00183 | 1/1983 | WIPO . |
| WO91/07566 | 5/1991 | WIPO . |

*Primary Examiner*—Ramon S. Britts
*Assistant Examiner*—Frank S. Tsay
*Attorney, Agent, or Firm*—Foley & Lardner

[57] ABSTRACT

A pressure converter for deep drilling keeps contaminated drill mud outside of the working mechanisms of the drill fluid. Thus, the inner drill mechanisms are kept clean by drill fluid. The device contains a rotatable valve positioned above the controlling piston. A tap cover, containing the valve, has two diametrically opposed inlets and two diametrically opposed outlets. The valve has a through passage which is connected to the inlets when the valve is in a second position. Thus, when the piston is operating in a return fashion, the drilling fluid is provided to the area beneath the piston head, keeping this area clean of drill mud.

11 Claims, 4 Drawing Sheets

PRESSURE CONVERTER

BACKGROUND OF THE INVENTION

This invention relates to an improved design of a pressure converter for mounting above the drill bit at the lower end of a drill pipe for deep drilling, in particular for oil and gas, for the purpose of generating an increased fluid pressure by utilizing energy in a drill fluid flow downwards through the drill pipe.

The object of the invention is to provide improvements in a pressure converter of the kind being subject to the applicant's international patent application PCT/NO90/00164, whereby it has been found possible to obtain more advantageous solutions in certain important parts of the design.

Various proposals are previously known for such utilization of the drill fluid flow, in particular in order to obtain an enhanced or more efficient drill operation. An example of such known techniques is to be found in the international patent application, PCT/EP82/00147. This example relates to the employment of an impact effect brought about with the drill fluid flow as a source of energy, so as to enhance the drilling action.

Of particular interest to the present invention is the employment of one or more high pressure jets adapted to make the drilling more effective by providing a cutting action in a surrounding rock formation. This is also previously known per se, inter alia from U.S. Pat. No. 3,112,800, which describes a method including the use of a pressure converter apparatus for generating the required high pressure. The invention, however, is directed to a novel design of a pressure converter for generating the required high fluid pressure.

International patent application PCT/NO90/00164 relates to a pressure converter comprising drive means adapted to be driven by the drilling fluid flow and to move valve means controlling piston means for reciprocating movement with a pressure stroke and a return stroke, said piston means having at one side a relatively large piston area adapted to be subjected to the drilling fluid pressure in the drill pipe during the pressure stroke, and having at the other side a first, opposite piston area which both during the pressure stroke and the return stroke is subjected to the return pressure in the drilling fluid flow upwards outside the drill pipe, and a second, opposite and relatively small piston area which during the pressure stroke is adapted to generate an increased pressure in a smaller portion of the drilling fluid flow, whereby a check valve provides for discharge of this smaller portion of the flow to a header channel which leads forward to the drill bit, whereas the large piston area during the return stroke is adapted to be subjected to the return pressure outside the drill pipe and the small piston area to the pressure in the drill pipe.

SUMMARY OF THE INVENTION

The present invention aims at the attainment of an improved design of certain essential parts in a pressure converter of the kind referred to above. It is particularly an object of this invention to provide a pressure converter in which the valve means and cooperating structural parts have a more simple design and at the same time are more reliable and dependable than the earlier proposed solution. Such properties are of much significance under the rough environments in which these pressure converters shall operate.

According to the invention this is obtained thereby that the valve means has the form of a rotatable valve body the axis of rotation of which is parallel to or coincident with the axis of the piston means, and which is arranged in a top cover above the space in front of the large piston area, that the valve body has a diametrical through passage and a central opening from the passage into the piston space, that the top cover has an inlet and an outlet respectively, being pairwise diametrically opposed and adapted to communicate with the passage in different angular positions of the valve body.

As will be seen from the following description, this solution implies that the complete valve system can be built up without seals and is symmetrically balanced with respect to the large pressures influencing it during operation, so that rotation of the valve body does not have to overcome large frictional forces and can take place at a comparatively low torque.

Related to the above is also another problem to which the present invention is directed, and which has to do with the fact that drill mud during the return stroke mentioned, is carried into the pressure converter from the drill fluid flow outside the drill pipe. This drill mud flow contains particles and fragments from the drilling operation and may have an unfavourable effect on the movable parts of the pressure converter, in particular the piston means, cylinder surfaces and so on.

In a pressure converter as referred to above, a solution according to the invention to the latter problem in the first place consists in the provision of an outlet for the return flow from the space in front of the large piston area to communicate directly with the space in front of the first, opposite piston area. When the valve body assumes its position for the return stroke, the flow of drill mud accordingly will be from the former space to the latter space.

With this solution the spaces and volumes concerned will be filled and kept clean by drill fluid from above being free of particles, so that contaminated drill mud from the annulus outside the drill pipe cannot enter and cause problems.

Further particular features of the pressure converter according to the invention are stated in the claims.

BRIEF DESCRIPTION OF THE DRAWINGS

In the following description the invention shall be explained more closely with reference to the drawings, in which.

DESCRIPTION OF THE PREFERRED EMBODIMENTS

Figure 1:
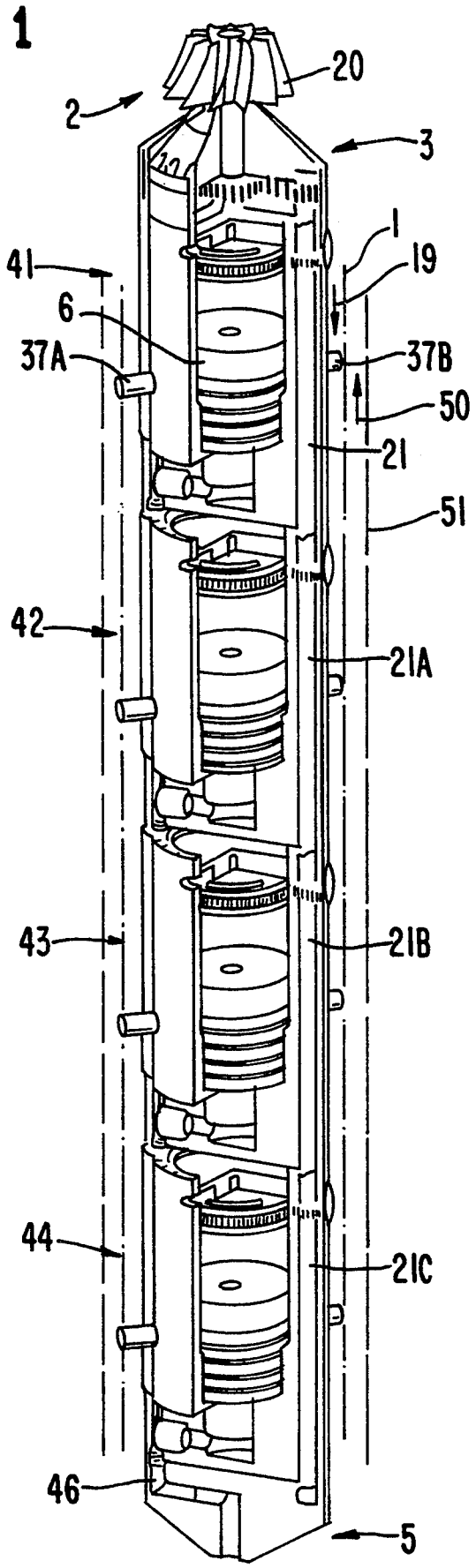
FIG. 1 corresponds to FIG. 7 in international patent application PCT/NO90/00164 and shows an overview of a group of four pressure converter units with a surrounding drill pipe or drill string and a casing schematically illustrated.

FIG. 1 shows an arrangement according to international patent application PCT/NO90/00164, with four pressure converter units 41, 42, 43 and 44 being interconnected in the longitudinal direction and end to end, whereby a top piece 3 is mounted on unit 41, whereas a bottom piece 5 is mounted on unit 44. At converter unit 41 there are indicated tube members 37A and 37B serving to connect the unit to the annulus between the drill pipe 1 and the casing 51, wherein during operation there is an upwardly directed drill mud flow 50. Correspondingly, there is a downwardly directed flow 19 of drill fluid within the drill pipe or string 1. Moreover, there is shown a drive axle 21 which is rotationally coupled to the drive axle 21A, 21B and 21C respectively of the other units.

The top piece 3 carries drive means in the form of a turbine 20 adapted to be driven by the drilling fluid flow, whereby a gear transmission conveys the power from the turbine axle to the assembled drive axles for rotating these in common and thereby provide for the intended control of the valve means in the converter units. It is an advantage to have these phase shifted, i.e., with mutual angular displacement, so that the pressure strokes and thereby the high pressure output from each of the units to the common header channel are smoothed to a more constant high pressure flow than will result from each individual pressure converter. Two other check valve 5 (not shown) admit drill mud to the high pressure space 32 from the main flow of drill mud within the surrounding drill pipe. At 46 the header channel is extended into the bottom piece 5 which has a central outlet for further fluid flow to the region at the drill bit (not shown).

While the pressure converter units in FIG. 1 are considered to be of a design being in the principle as described in the international patent application mentioned above, FIGS. 2, 3 and 4 of the present drawings show a new design of the pressure converter module, which makes it possible to obtain the improvements and the advantages mentioned before.

The problem referred to can be explained more closely with reference to the operation of the converter group in FIG. 1, as follows:

Drill fluid 19 coming from above down through the drill string 1 and being lead to the upper side of the piston 6 (in pressure converter 41), has passed through a filter and a pump on the drill deck of a drill rig for example, in offshore operations. This part of the drill fluid therefore is very clean and free of particles. On the contrary the drill fluid (mud) 50 which has passed through the drill bit and flows upwards outside the drill string 1, will entrain all fragments from the drilling and is therefore full of particles of all sizes.

Drill fluid from the surface at an overpressure of for examples 300 bar is lead to the upper side of piston 6 in order to carry out a pressure or work stroke, and during this work stroke the least possible resistance is desired at the underside of the piston. Therefore, tube member connections or channels 37A and 37B and so forth are provided to the annulus between the drill string 1 and the casing 51, where the upwardly directed drill mud flow 50 moves at an overpressure of for example 20 bar.

The space at the underside of piston 6 is filled each time through the tube connections 37A and 37B when piston 6 moves upwards, so that drill mud from outside the drill string 1 containing particles from the drilling, will enter the space and cause problems as mentioned.

What is explained immediately above relates to the pressure converter units in FIG. 1, which are considered to be of a design in the principle as described in the above international patent application. However, FIGS. 2, 3 and 4 of the present drawings show a new design of the pressure converter module which makes it possible to avoid the problems discussed.

Figure 2:
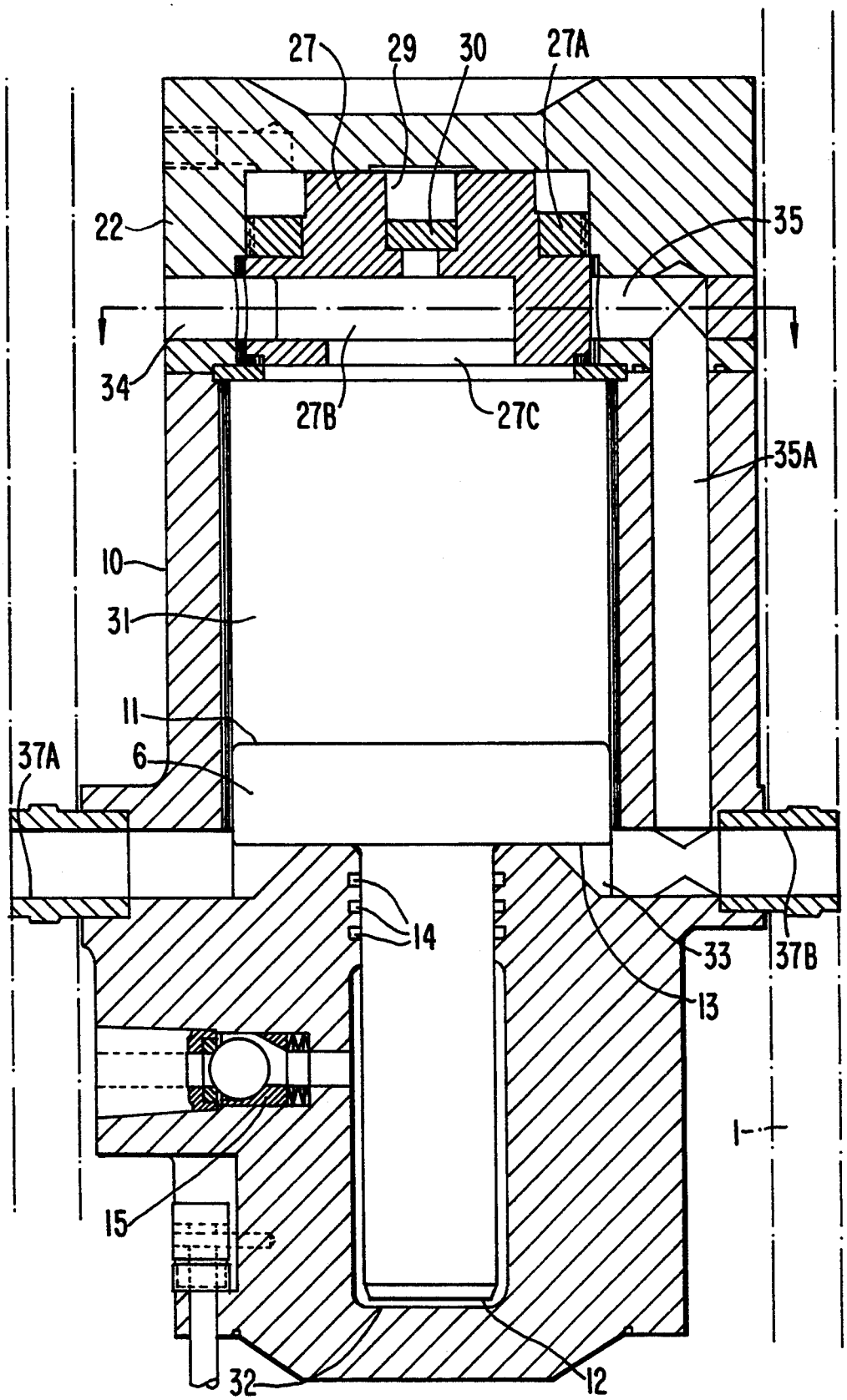
FIG. 2 shows in axial section substantial parts of the pressure converter based on design features according to the invention, with valve means in a position corresponding to the pressure stroke of the converter.
Figure 3:
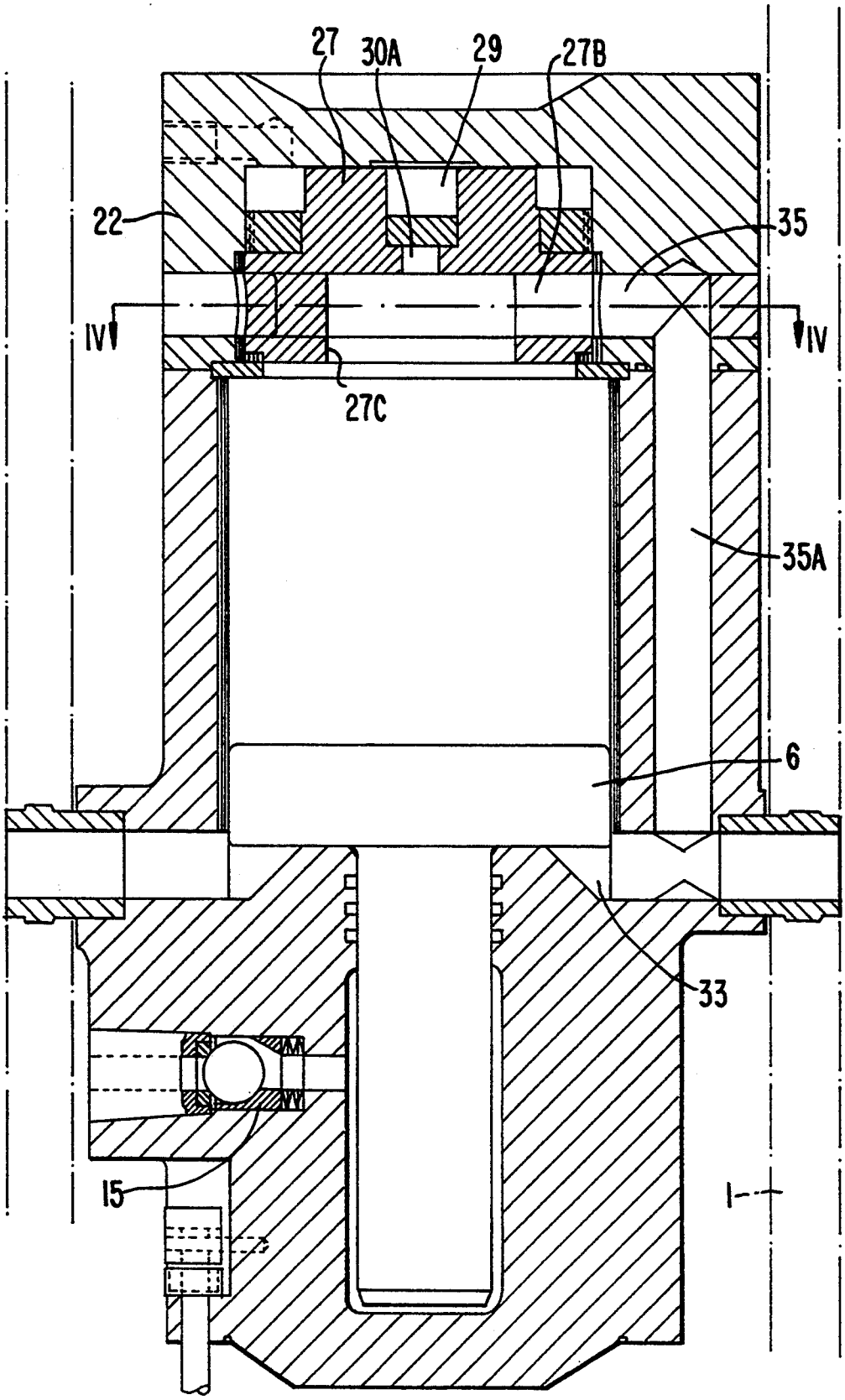
FIG. 3 shows a section similar to the one in FIG. 2, enlarged in order to show details more clearly, but with the valve means in an angular position corresponding to the return stroke.
Figure 4:
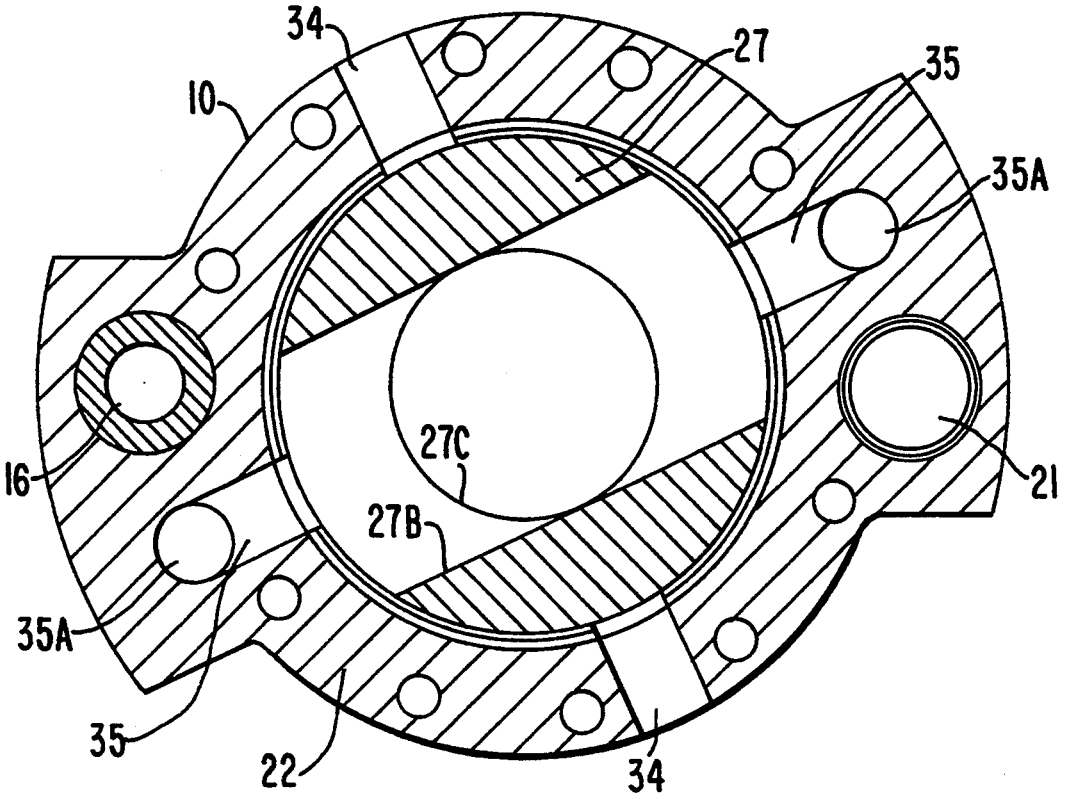
FIG. 4 shows a cross-section along the line IV—IV in FIG. 3, i.e. with the valve means in a position corresponding to the return stroke.

As in the previously proposed design the one shown in FIGS. 2, 3 and 4 also comprises a generally cylindrical housing 10 adapted to receive a piston 6. This has three operative piston areas, namely an upper, relatively large piston area 11, a first, opposite piston area 13 and a second opposite and relatively small piston area 12 at the lower end of piston means 6. This is adapted to be freely movable axially under the influence of varying drilling fluid pressures on the respective piston areas.

The space or volume 31 in front of piston area 11 can be denoted low pressure space, whereas volume 32 in front of piston area 12 correspondingly can be denoted high pressure space. Through a check valve 15 this latter space is connected to a header channel 16 for the resulting drilling fluid flow at an increased pressure. The channel 16 runs through the housing 10 in the whole longitudinal direction thereof for the purpose of interconnecting several such pressure converter units to a group, as shown for example in the principle in FIG. 1.

The sectional views in FIGS. 2 and 3 are mutually displaced by an angle of 90° (cf. FIG. 4) at either side of the center line (upper part). Thus, there is shown an inlet channel 34 (FIG. 2) and an outlet channel 35 (FIG. 3) for the space 31 above piston 6, whereby valve means 27 is adapted to control the inlet and outlet respectively. For this purpose valve means or body 27 has a diametrical through passage 27B with a central downwardly directed opening 27C which in this embodiment is shown with a circular cross-section (FIG. 4). Valve body 27 is arranged to be rotatable and is provided with a toothed rim 27A for the rotary movement. This movement is provided for by means of (not shown) gear transmission from the drive axle 21.

Starting from a situation in which piston 6 is in its upper position and valve body 27 admits drill fluid to the upper side of the piston through the inlet channels 34, piston 6 will be urged downwards. Thereby fluid being present in space 33 in front of the piston area 13 at the underside of piston 6, will flow out through the connections 37A and 37B to the annulus between the drill string 1 and the casing. Piston 6 is driven down to its bottom position as shown in FIG. 2.

In order to obtain a return stroke of the piston, valve 27 is set to the position shown in FIG. 3 and FIG. 4, where there is opened for outflow through outlet channels 35 and a continuation thereof in the form of two transfer channels 35A running in the axial direction through the cylinder wall 10 down to space 33 at the underside of piston 6 and the tube connections 37A and 37B adjacent thereto, which communicate with the upwardly directed drill mud flow outside the drill string. Clean drill fluid from the upper side of piston 6 will be pressed out through transfer channel 35A and by and by will fill space 33 when this expands during the upward piston movement. Accordingly, drill mud from the annulus is prevented from penetrating into the tube connections 37A and 37B and contaminate or damage interior parts of the pressure converter, such as the movable piston 6 with its associated cylinder lining, and the downward extension of the piston means with the lower piston area 12 as well as seals 14.

As will appear best from FIG. 4 there are provided two diametrically opposed inlets 34—34 and two diametrically opposed outlets 35—35 with an angular displacement of 90° between inlet and outlet. Rotation of valve body 27 comprising the passage 27B by an angle of (in the principle) 90° accordingly will change the operation from pressure stroke to return stroke and vice versa in the pressure converter.

The sectional view in FIG. 3 together with FIG. 4 shows design features being important to the operation of the valve means or body 27 together with the surrounding top cover 22 which closes the cylindrical piston housing 10 upwards. Between valve body 27 and the adjacent portions of the top cover 22, in particular at cooperating cylindrical wall parts thereof, there is provided a lining of a wear-resistant material, for example a ceram. Thus, the regions around inlets 34—34 and outlets 35—35 will be covered by this lining. The choice of such a material in the lining combined with very fine tolerances in the machining of the cooperating surfaces for the rotary movement of the valve body 27, result in a neglectable wear during rotary movement at the same time as required sealing will be obtained without employing conventional sealing or packing elements. This latter feature contributes to a substantial degree to lowering the friction so that the rotary movement can take place more easily.

The symmetrical arrangement of inlets, outlets and through passage 27B in valve body 27, results in a very favourable balancing of the complete valve system, which involves great advantages when taking into consideration the rather high pressures which occur under operation of such a pressure converter, i.e. the pressure of the drill fluid during the various phases of operation. Moreover, from a closer consideration of FIG. 4 it will appear that the width of the passage 27B is somewhat smaller than the spacing between an inlet 34 and outlet 35 along the interior circumference, i.e. along the lining. Thus, the change between work stroke and return stroke of the piston means will take place quickly without any intermediate dead time.

In addition to the above mentioned balancing as a result of the symmetrical arrangement of inlets and outlets etc., FIG. 3 shows one or more cavities 29 which communicate with each other at the upper side of valve body of 27. These cavities 29 are delimited upwards and sideways by the surrounding top cover 22. The toothed rim 27A mentioned above for rotating the valve body, is accommodated in the peripheral portions of these cavities 29. The space therein is advantageously filled with a lubricant, for example a relatively thick grease, among other things for lubricating the gear transmission to the toothed rim 27A. For pressure equalization between the cavities 29 and the varying pressure in passage 27B, there is provided a freely movable piston 30 which at its underside is exposed to the pressure in passage 27B through a centrally located axial bore 30A. This pressure equalization together with the symmetrical balancing referred to above, will to a high degree facilitate the rotary movement of valve body 27 and in connection therewith involve a reduced wear thereof.

It is obvious that the piston 30 may be replaced by other forms of separation means which can form a movable liquid seal between the cavities 29 and passage 27B. For example such a separation means may take the form of a liquid tight fabric or a membrane. Also at other points the design illustrated in the drawings may be modified, for example the cross-sectional shape and the location of the inlets and outlets described, as well as the passage and the central downward opening 27C in the valve body. Moreover, embodiments may be contemplated in which the number of pairs of inlets and outlets can be larger than the two inlets 34—34 and two outlets 35—35 shown in the drawings.

I claim:

1. A pressure converter for mounting above a drill bit at a lower end of a drill pipe comprising:

a valve;

a controlling piston having at one side a relatively large piston area and at an opposite side a relatively small piston area, the controlling piston being positioned in a piston space such that the relatively large piston area is in a low pressure piston space and the relatively small piston area is in a high pressure piston space;

a check valve connected to the high pressure piston space such that in response to movement of the small piston area within the high pressure piston space, the drilling fluid flows through a header channel to the drill bit;

wherein the valve comprises a rotatable valve body having an axis of rotation parallel to an axis of the controlling piston and being positioned in a top cover above the low pressure piston space, the valve body having a diametrical through passage connected via a central opening to the low pressure piston space;

the top cover having two diametrically opposed inlets and two diametrically opposed outlets, each of the inlets being connected to one end of the through passage when the valve body is in a first position, and each of the outlets being connected to one end of the through passage when the valve body is in a second position.

2. A pressure converter according to claim 1, wherein the two diametrically opposed inlets have an angular position being displaced by 90° with respect to the two diametrically opposed outlets.

3. A pressure converter according to claim 2, wherein a width of the through passage is smaller than the spacing between an inlet and an outlet.

4. A pressure converter according to claim 1, wherein a lining of a wear-resistant material is provided on portions of the surfaces of the valve body and the top cover.

5. A pressure converter according to claim 1, wherein the valve body and the top cover define cavities containing a lubricant, the cavities being substantially liquid tight and separated from the through passage by means of movable separation means.

6. A pressure converter according to claim 5, wherein the separation means has the form of a freely movable piston contained in a cylinder part, the freely movable piston being connected via a bore to the through passage.

7. A pressure converter according to claim 5, further comprising a toothed rim positioned inside the cavities.

8. A pressure converter according to claim 1, wherein the large piston area is subjected to return pressure outside the drill pipe and the small piston area is subjected to pressure in the drill pipe, at least one outlet being connected directly to a lower portion of the low pressure piston space.

9. A pressure converter according to claim 8, wherein a transfer channel connecting the at least one outlet to the low pressure piston space is contained in a wall of a cylinder, the interior of the cylinder defining the piston space.

10. A pressure converter according to claim 9 wherein a tube connection connects the lower portion of the low pressure piston space to an annulus outside the drill pipe, the tube connection extending radially out from the lower end of the transfer channel.

11. A pressure converter according to claim 8, wherein the two outlets each have an associated transfer channel.

* * * * *